US009718132B2

(12) United States Patent
Lee et al.

(10) Patent No.: US 9,718,132 B2
(45) Date of Patent: Aug. 1, 2017

(54) MANUFACTURING METHOD OF SPHERICAL GOLD (AU) NANOPARTICLES AND SPHERICAL GOLD (AU) NANOPARTICLE MANUFACTURED BY USING THE SAME

(71) Applicants: Korea Basic Science Institute, Daejeon (KR); Research & Business Foundation SUNGKYUNKWAN UNIVERSITY, Suwon-si, Gyeonggi-do (KR)

(72) Inventors: Gaehang Lee, Daejeon (KR); Gi-Ra Yi, Suwon-si (KR); You-Jin Lee, Gongju-si (KR); Dong Kwan Kim, Seoul (KR)

(73) Assignees: Korea Basic Science Institute, Daejeon (KR); Research & Business Foundation SUNGKYUNKWAN UNIVERSITY, Suwon-si, Gyeonggi-do (KR)

( * ) Notice: Subject to any disclaimer, the term of this patent is extended or adjusted under 35 U.S.C. 154(b) by 1 day.

(21) Appl. No.: 14/541,483

(22) Filed: Nov. 14, 2014

(65) Prior Publication Data

US 2015/0290714 A1 Oct. 15, 2015

(30) Foreign Application Priority Data

Apr. 14, 2014 (KR) ..... 10-2014-0044161

(51) Int. Cl.

| | |
|---|---|
| ***B22F 9/24*** | (2006.01) |
| ***B22F 1/00*** | (2006.01) |
| ***C23F 1/04*** | (2006.01) |
| ***C23F 1/30*** | (2006.01) |

(52) U.S. Cl.

CPC ..... *B22F 9/24* (2013.01); *B22F 1/0018* (2013.01); *B22F 1/0048* (2013.01); *C23F 1/04* (2013.01); *C23F 1/30* (2013.01); *B22F 2001/0037* (2013.01); *B22F 2301/255* (2013.01); *B22F 2999/00* (2013.01)

(58) Field of Classification Search

None

See application file for complete search history.

(56) References Cited

U.S. PATENT DOCUMENTS

| | | | | |
|---|---|---|---|---|
| 8,058,640 | B2 * | 11/2011 | Lieber | B82Y 30/00 117/86 |
| 2006/0014001 | A1 * | 1/2006 | Zhang | B82Y 10/00 428/195.1 |
| 2009/0298115 | A1 * | 12/2009 | Chang | G01N 33/587 435/29 |

(Continued)

FOREIGN PATENT DOCUMENTS

| | | | |
|---|---|---|---|
| KR | 20080069058 | A | 7/2008 |
| KR | 20110019224 | A | 2/2011 |

OTHER PUBLICATIONS

Lee, You-Jin, et al., "Ultrasmooth, Highly Spherical Monocrystalline Gold Particles for Precision Plasmonics", ACS Nano, vol. 7, No. 12, Nov. 12, 2013, pp. 11064-11070.

*Primary Examiner* — George Wyszomierski

(74) *Attorney, Agent, or Firm* — McCoy Russell LLP

(57) ABSTRACT

Provided is a manufacturing method of uniformly spherical gold nanoparticles using a synthesis method for controlling a size and a shape by repeating an etching and growing.

8 Claims, 15 Drawing Sheets

(56) References Cited

U.S. PATENT DOCUMENTS

2012/0195833 A1* 8/2012 Lin ..... A61K 49/223
424/9.1
2014/0377876 A1* 12/2014 Lee ..... B22F 1/0018
436/102

* cited by examiner

MANUFACTURING METHOD OF SPHERICAL GOLD (AU) NANOPARTICLES AND SPHERICAL GOLD (AU) NANOPARTICLE MANUFACTURED BY USING THE SAME

CROSS-REFERENCE TO RELATED APPLICATIONS

This application claims priority under 35 U.S.C. §119 to Korean Patent Application No. 10-2014-0044161, filed on Apr. 14, 2014, in the Korean Intellectual Property Office, the disclosure of which is incorporated herein by reference in its entirety.

TECHNICAL FIELD

The following disclosure relates to a manufacturing method of gold (Au) nanoparticles, and more specifically, to a manufacturing method of uniformly spherical gold (Au) nanoparticles using a simple synthesis method capable of controlling a size and a shape by repeating an etching and growing mechanism, and a spherical gold (Au) nanoparticle manufactured by using the same.

BACKGROUND

In general, when a metal material has a small size, such as a nanometer unit, the metal material has physical and chemical properties that are completely different from when they are in the existing bulk state. For example, when gold, which is one of the metal material, becomes a gold (Au) nanoparticle in a nanometer size, gold (Au) nanoparticle has unique properties different from that when it is in the bulk state, which is significantly useful for photoelectrons, electronic devices, bio-devices, sensors, and the like, depending on the unique properties.

Specifically, when light is irradiated on a surface of the gold (Au) nanoparticles, resonance between the light and a free electron of the gold is generated and shows unique optical properties such as scattering, absorption, and the like. Therefore, even though a shape and a size of the metal nanoparticles are slightly changed, a noticeable difference occurs in view of spectroscopy patterns.

In recent years, a novel structure is formed by using precise linker molecules such as a number of thiol groups having various lengths or various kinds of functional groups or DNA to assemble the gold (Au) nanoparticles, which is significantly used as a nano photonic device or optical materials.

In addition thereto, synthesis of the gold (Au) nanoparticles has actively been conducted as a basis for research searching properties of the nanoparticles, and various shaped gold (Au) nanoparticles such as octahedron, cube, decahedron, rod, and the like, have been synthesized by various methods until now.

However, even though the research related to synthesis of the gold (Au) nanoparticles has been conducted, synthesis of pure gold spherical nanoparticles having a size of 100 nm or more has not been reported yet.

Meanwhile, technology of synthesizing isotropic shaped nanoparticles having a size of 100 nm or less by a controlling process using surfactant in a bottom-up scheme has already been known in the art. However, when the nanoparticles to be manufactured are synthesized to have a size of 100 nm or more, it is not within the growing controllable range of the surfactant, such that a difference in a growing rate eventually occurs between crystal planes, such that a problem occurs in the nanoparticles only having non-isotropic shape are obtained.

Nevertheless, spherical shapes capable of simplifying assembly of the particles and performing a symmetrical assembly are industrially utilized, and in particular, the spherical gold (Au) nanoparticles has gradually received attention due to high optical utilization.

Therefore, there is a need for the development of a manufacturing method which is appropriate for producing a thermally stable and uniformly spherical gold nanoparticle having a size of 100 nm or more.

RELATED ART DOCUMENT (Patent Document 1) Korean Patent Laid-Open Publication No. KR 2011-0019224

SUMMARY

An embodiment of the present invention is directed to providing a manufacturing method of gold (Au) nanoparticles having a size of 100 nm or more by a simplified process when manufacturing the gold (Au) nanoparticles. In addition, another embodiment of the present invention is directed to providing a thermally stable and uniformly spherical gold nanoparticle having a size of 100 nm or more manufactured by using a cation-based surfactant.

Further, another embodiment of the present invention is directed to providing gold (Au) nanoparticles having various shapes and sizes manufactured by the manufacturing method.

In one general aspect, there is provided a manufacturing method of spherical gold (Au) nanoparticles including: (a) manufacturing gold (Au) nanoparticles by heating a reaction solution containing a gold precursor, a cationic surfactant, an inorganic acid, and a reducing solvent; (b) primarily etching the gold (Au) nanoparticles by cooling the reaction solution to room temperature and additionally injecting the gold precursor into the reaction solution; (c) re-growing the gold (Au) nanoparticles to have a polyhedral shape by heating the reaction solution; and (d) secondarily etching the gold (Au) nanoparticles by cooling the reaction solution to room temperature and additionally injecting the gold precursor into the reaction solution, wherein one unit process consisting of the re-growing of the gold (Au) nanoparticles (c) and the secondary etching of the gold (Au) nanoparticles (d) is performed one or more times.

The manufacturing of the gold (Au) nanoparticles (a) may include heating the reaction solution containing 500 to 3000 parts by weight of the cationic surfactant and 500 to 3000 parts by weight of the inorganic acid based on 100 parts by weight of the gold precursor.

In the primary etching of the gold (Au) nanoparticles (b) or the secondary etching of the gold (Au) nanoparticles (d), 20 to 30 parts by weight of the gold precursor based on 100 parts by weight of the gold precursor in the manufacturing of the gold (Au) nanoparticles (a) may be additionally injected into the reaction solution.

In the primary etching of the gold (Au) nanoparticles (b) or the secondary etching of the gold (Au) nanoparticles (d), the gold precursor may be additionally injected into the reaction solution, and the etching may be performed for 15 to 20 hours.

The re-growing of the gold (Au) nanoparticles (c) may include: forming a dispersion liquid by mixing the gold (Au) nanoparticles separated and obtained from the primary etching of the gold (Au) nanoparticles (b) with a dispersion medium consisting of any one selected from the group consisting of 1,5-pentanediol, 1,3-propanediol and diethylene glycol, or a mixed solution containing two or more kinds thereof; and re-growing the gold (Au) nanoparticles to have a polyhedral shape by heating the reaction solution.

The gold precursor may be tetrachloroauric (III) acid ($HAuCl_4$).

The reducing solvent may be any one selected from the group consisting of glycolic solvents including ethylene glycol, diethylene glycol, triethylene glycol, tetraethylene glycol, polyethylene glycol, propylene glycol, dipropylene glycol, polypropylene glycol, hexylene glycol and 1,2-hexadecanediol, or glycol ether solvents including methyl glycol, butyl glycol, butyl triglycol, butyl polyglycol, hexyl glycol, hexyl diglycol, ethyl hexyl glycol, ethyl hexyl diglycol, aryl glycol, phenyl glycol, phenyl diglycol, benzyl glycol, methyl propylene glycol, methyl propylene diglycol, methyl propylene triglycol, propyl propylene glycol, propyl propylene diglycol, butyl propylene glycol, butyl propylene diglycol, phenyl propylene glycol, and methyl propylene glycol acetate, or a mixture containing two or more kinds thereof.

The cationic surfactant may be any one selected from the group consisting of poly(dimethyldiallylammonium chloride), hexadecyltrimethylammonium bromide, and hexadecyltrimethylammonium chloride, or a mixture containing two or more kinds thereof.

The inorganic acid may be any one selected from the group consisting of sulfuric acid ($H_2SO_4$), hydrochloric acid (HCl), nitric acid ($HNO_3$), phosphoric acid ($H_3PO_4$), sulfamic acid ($SO_3HNH_2$), perchloric acid ($HClO_4$), chromic acid ($HCrO_4$), sulfurous acid ($H_2SO_3$) and nitrous acid ($HNO_2$), or a mixture containing two or more kinds thereof.

In another general aspect, there is provided a gold (Au) nanoparticle manufactured by the manufacturing method as described above.

DETAILED DESCRIPTION OF EMBODIMENTS

Hereinafter, a manufacturing method of spherical gold (Au) nanoparticles according to the present invention, and a spherical gold (Au) nanoparticle manufactured by using the same are described in detail with reference to the accompanying drawings. The drawings to be described below are provided by way of example so that the idea of the present invention can be sufficiently transferred to those skilled in the art to which the present invention pertains. Therefore, the present invention may be implemented in many different forms, without being limited to the drawings to be described below. The drawings may be exaggerated in order to specify the spirit of the present invention. Here, unless technical and scientific terms used herein are defined otherwise, they have meanings understood by those skilled in the art to which the present invention pertains. Known functions and components which obscure the description and the accompanying drawings of the present invention with unnecessary detail will be omitted.

Figure 1:
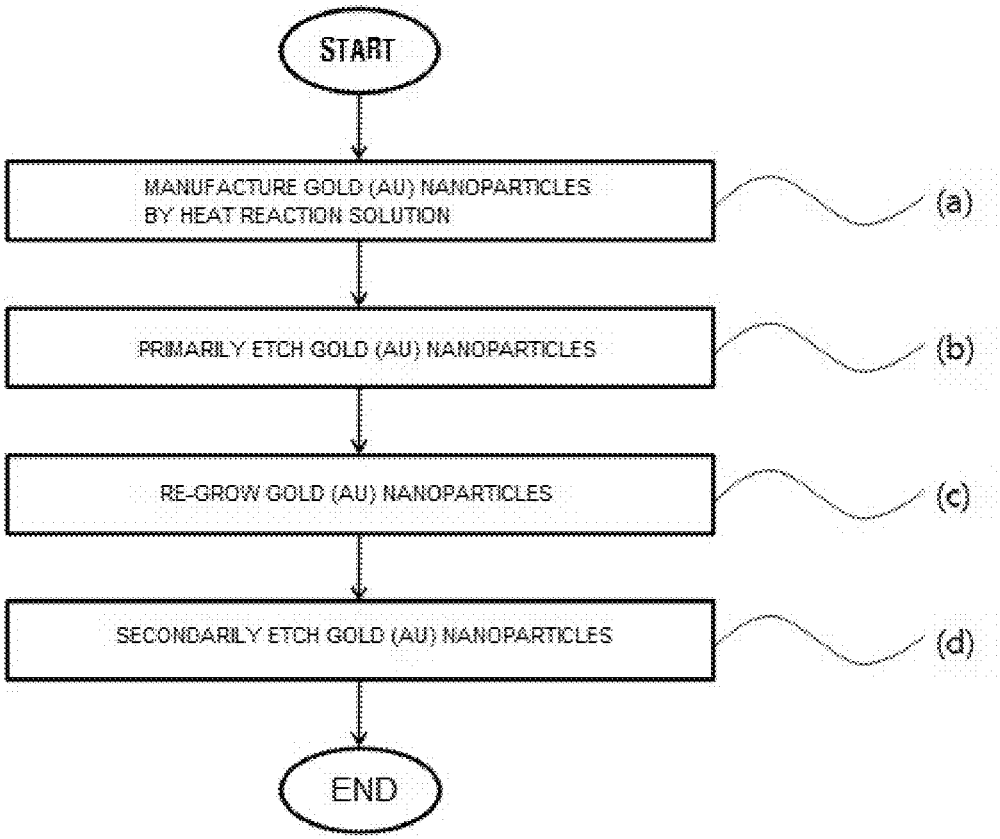
FIG. 1 is a process flow chart schematically showing a manufacturing method of spherical gold (Au) nanoparticles according to an exemplary embodiment of the present invention.
Figure 2A:
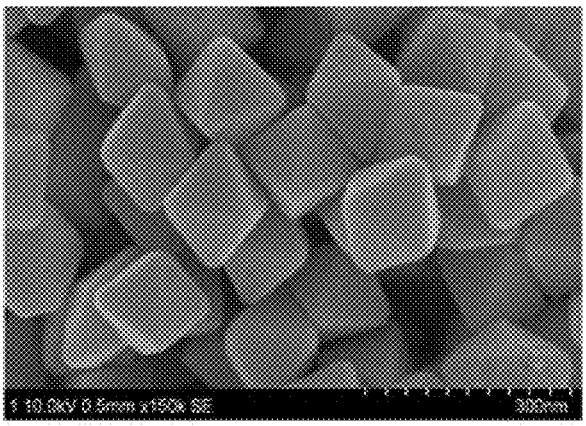
FIGS. 2*a* to 2*d* are scanning electron microscope (SEM) photographs of gold (Au) nanoparticles manufactured by Examples 1 to 4 in sequence.
Figure 2B:
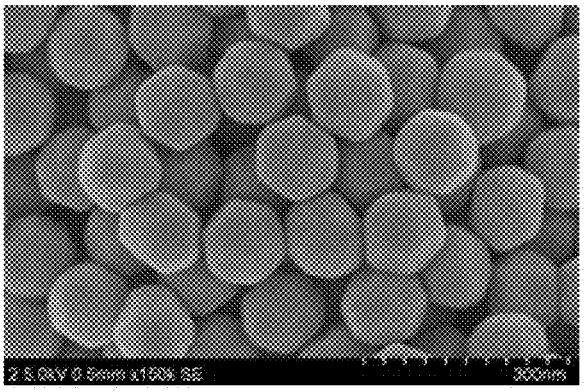
Figure 2C:
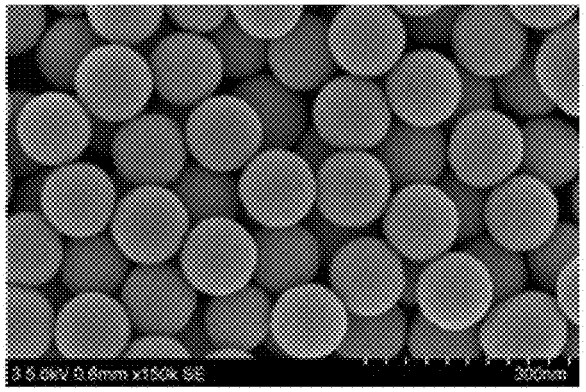
Figure 2D:
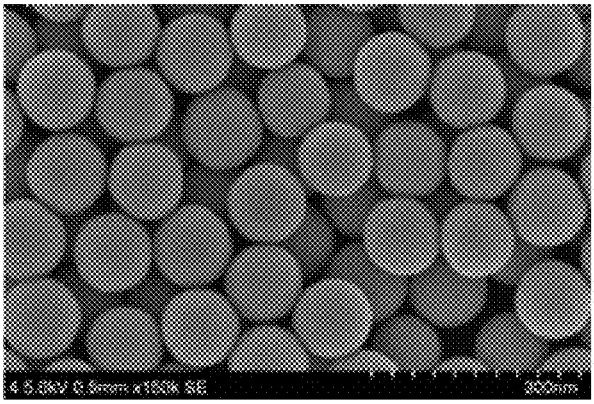

A manufacturing method of gold (Au) nanoparticles according to the present invention includes: (a) manufacturing gold (Au) nanoparticles by heating a reaction solution, (b) primarily etching the gold (Au) nanoparticles, (c) re-growing the gold (Au) nanoparticles; and (d) secondarily etching the gold (Au) nanoparticles, wherein one unit process consisting of the re-growing of the gold (Au) nanoparticles (c) and the secondary etching of the gold (Au) nanoparticles (d) is performed one or more times, as shown in FIG. 1. Here, the re-growing disclosed in the manufacturing method of the gold (Au) nanoparticles means growing once grown crystal (nanoparticle-shaped crystal) again and includes that the shape, the size, or the shape and the size of the crystal (nanoparticle-shaped crystal) are changed.

In detail, the reaction solution is firstly prepared, and the gold (Au) nanoparticles in the reaction solution are manufactured. Here, the reaction solution contains a gold precursor, a cationic surfactant, an inorganic acid, and a reducing solvent, and when the reaction solution having all raw materials mixed thereinto is heated, the gold (Au) nanoparticles are produced in the reaction solution to be a colloid.

When the reaction solution is heated to manufacture the gold (Au) nanoparticles, heating temperature of the reaction solution may be 0.9 $T_{b1}$ to 1.1 $T_{b1}$ based on a boiling point ($T_{b1}$, ° C.) of the reducing solvent. The heating temperature is a temperature range at which nucleation and growth of the gold (Au) nanoparticles are smoothly achieved by an activated oxidation-reduction reaction. In an exemplary embodiment, the reaction solution may be heated at a temperature of 180° C. to 220° C.

Here, the gold precursor is directly reduced to produce the gold (Au) nanoparticles, and is a raw material directly involved in the growth or the etching reaction of the produced gold (Au) nanoparticles, and may be any appropriate materials without limitation as long as the material is dissociated in the reaction solution to form $AuCl_4^-$ ions. As an example thereof, tetrachloroauric (III) acid ($HAuCl_4$) is preferred to secure yield of the gold (Au) nanoparticles reproducible after the process.

In addition, the manufactured gold (Au) nanoparticles are obtained by washing and separating processes after the reaction is completed, the raw material is not significantly limited in view of an amount; however, it is preferable to limit an amount of the gold precursor in order to prevent unnecessary waste of the raw materials in the reaction of producing the gold (Au) nanoparticles and to inhibit impurities during the reaction. In detail, the gold precursor is preferably contained in 1 wt % or less based on mass of the total reaction solution, and more preferably, in 0.01 to 1 wt %, and even more preferably, in 0.01 to 0.1 wt %.

In addition, the reducing solvent is not limited as long as the reducing reaction of the gold precursor and the cationic surfactant is capable of being performed, and separate side-reactions do not occur; however, an organic solvent is preferred, and specifically and preferably, the reducing solvent may be selected from glycolic solvents or glycol ether solvents.

Examples of the reducing solvent may include any one selected from the group consisting of glycolic solvents including ethylene glycol, diethylene glycol, triethylene glycol, tetraethylene glycol, polyethylene glycol, propylene glycol, dipropylene glycol, polypropylene glycol, hexylene glycol and 1,2-hexadecanediol, or glycol ether solvents including methyl glycol, butyl glycol, butyl triglycol, butyl polyglycol, hexyl glycol, hexyl diglycol, ethyl hexyl glycol, ethyl hexyl diglycol, aryl glycol, phenyl glycol, phenyl diglycol, benzyl glycol, methyl propylene glycol, methyl propylene diglycol, methyl propylene triglycol, propyl propylene glycol, propyl propylene diglycol, butyl propylene glycol, butyl propylene diglycol, phenyl propylene glycol, and methyl propylene glycol acetate, or a mixture containing two or more kinds thereof.

Similar to the above-mentioned gold precursor, the reducing solvent is not significantly limited in view of an amount; however, the reducing solvent preferably has a predetermined amount or more in order to secure reducing efficiency of the gold precursor, to prevent unnecessary waste of the raw materials in the reaction of producing the gold (Au) nanoparticles, and to inhibit impurities during the reaction.

Specifically, the reducing solvent may be dissociated from the gold precursor and may be contained in 3 mol or more based on 1 mol of tetrachloro gold (III)-ion ($AuCl_4^-$) present in the reaction solution. More specifically, the reducing solvent may have 400000 to 700000 parts by weight based on 100 parts by weight of the gold precursor, and more specifically, 450000 to 650000 parts by weight, and even more specifically, 480000 to 600000 parts by weight.

In addition, the cationic surfactant is oxidation-reduction reacted with the gold precursor in the reaction solution to synthesize the gold (Au) nanoparticles, or to become the raw material etching a surface portion of the gold (Au) nanoparticles, and the cationic surfactant is preferably any one selected from the group consisting of poly(dimethyldiallylammonium chloride), hexadecyltrimethylammonium bromide, and hexadecyltrimethylammonium chloride, or a mixture containing two or more kinds thereof, in order to effectively perform the oxidation-reduction reaction with the tetrachloroauric (III) acid ($HAuCl_4$) which is the gold precursor. Among them, poly(dimethyldiallylammonium chloride) is more preferred in view of efficiency in synthesizing and etching the gold (Au) nanoparticles.

Here, the cationic surfactant may grow the gold (Au) nanoparticles to have any polyhedral shape in a direction in which the synthesized gold (Au) nanoparticles reach to a stable state depending on reaction temperature or reaction time with the gold precursor, and in addition, at the time of etching processes (including primary etching process and secondary etching process) to be described below, a protruding portion of the surface of the gold (Au) nanoparticles may be etched. In order to secure smooth reaction depending on the reaction condition, the amount of the cationic surfactant is important. When the amount of the cationic surfactant is not significant based on the amount of the gold precursor, the synthesis of the gold (Au) nanoparticles, or the etching process of the surface of the gold (Au) nanoparticles may not be satisfactorily achieved. In this regard, the cationic surfactant is preferably contained in 500 to 3000 parts by weight based on 100 parts by weight of the gold precursor of the solution reaction, and more preferably, 1000 to 2800 parts by weight, and even more preferably, 1500 to 2500 parts by weight.

In addition, the inorganic acid contained in the reaction solution is dissociated in the reaction solution to serve as an adjuster adjusting a reduction rate by a common ion effect. The inorganic acid may be any one selected from the group consisting of sulfuric acid ($H_2SO_4$), hydrochloric acid (HCl), nitric acid ($HNO_3$), phosphoric acid ($H_3PO_4$), sulfamic acid ($SO_3HNH_2$), perchloric acid ($HClO_4$), chromic acid ($HCrO_4$), sulfurous acid ($H_2SO_3$) and nitrous acid ($HNO_2$), or a mixture containing two or more kinds thereof, in order to prevent unnecessary reaction with other raw materials in the reaction solution and to be stably dissociated to induce effective common ion effect.

Specifically, in order to manufacture the gold (Au) nanoparticles having a uniform size in the manufacturing of the gold (Au) nanoparticles (a), the inorganic acid is preferably contained in 500 to 3000 parts by weight based on 100 parts by weight of the gold precursor, and more preferably, 1000 to 2000 parts by weight, and even more preferably, 1400 to 1700 parts by weight.

When the reaction solution containing the gold precursor, the cationic surfactant, the inorganic acid, and the reducing solvent is manufactured as described above, the gold precursor is reacted with the reducing solvent in the reaction solution depending on reaction properties of each of the above-mentioned raw materials to manufacture the gold (Au) nanoparticles, and when the reaction solution is heated and reacted at an increased temperature, surprisingly, the manufactured gold (Au) nanoparticles are reacted with gold precursor ion and the cationic surfactant present in the solution reaction to be grown as the gold (Au) nanoparticles in a polyhedral shape. Here, the grown gold (Au) nanoparticles having a polyhedral shape may be a gold (Au) nanoparticle having an octahedral shape which is relatively stable in surface energy distribution as compared to other gold (Au) nanoparticles having other polyhedral shapes.

In addition, before heating the reaction solution, stirring may be further performed at room temperature so that the raw materials contained in the reaction solution are uniformly mixed with each other.

Further, the gold (Au) nanoparticles having a polyhedral shape manufactured by the previous process are primarily etched. Specifically, after the reaction solution containing the manufactured gold (Au) nanoparticles having a polyhedral shape dispersed thereinto is cooled at room temperature, the gold precursor is primarily and additionally injected in a state in which the reaction solution is cooled to room temperature, and left for a predetermined time or more, and then, spherical gold (Au) nanoparticles in which a protruding region of an apex or an edge portion of the surface of the gold (Au) nanoparticles having a polyhedral shape is etched may be manufactured.

Here, the gold precursor is a raw material directly involved in the growth or the etching reaction of the gold (Au) nanoparticles, and includes any appropriate materials without limitation as long as the material is dissociated in the reaction solution to form $AuCl_4^-$ ions. As an example thereof, tetrachloroauric (III) acid ($HAuCl_4$) is preferred to secure yield of the gold (Au) nanoparticles reproducible after the process.

The gold precursor added in the primary etching of the gold (Au) nanoparticles (b) may be injected in an amount of 20 to 30 parts by weight based on the 100 parts by weight of the gold precursor in the manufacturing of the gold (Au) nanoparticles (a). Accordingly, the total size of the particles may be prevented from being excessively decreased during etching and removing the protruding region such as the edge and the apex of the gold (Au) nanoparticles manufactured in the manufacturing of the gold (Au) nanoparticles (a). The time required for the etching process may be at least 10 to 20 hours, and preferably, 15 to 20 hours.

During the primary etching process of b), stirring may be simultaneously performed. Here, in order to increase efficiency of the etching reaction, the primary and additional injection of the gold precursor may be simultaneously performed with the stirring of the reaction solution, wherein starting and ending time of the stirring are not significantly limited; but it is preferable to perform continuous stirring from prior to the primary and additional injection of the precursor until the time when the etching process is terminated, for effective etching process.

That is, in the etching process, the gold precursor is primarily and additionally injected while stirring the reaction solution, and the primarily and additionally injected gold precursor is reacted with the gold (Au) nanoparticles having a polyhedral shape manufactured by the previous process for a predetermined time to manufacture the spherical gold (Au) nanoparticles.

Then, the spherical gold (Au) nanoparticles manufactured by the previous process is re-grown. According to an exemplary embodiment of the method of re-growing the spherical gold (Au) nanoparticles manufactured by the previous process, the re-growing of the gold (Au) nanoparticles may be practiced by simply heating the reaction solution without adding a separate additive to provide energy required for growing a crystal. When energy is provided as described above, the spherical gold (Au) nanoparticles seem to be grown to be in a more stabilized crystal state. Accordingly, surprisingly, the spherical gold nanoparticles are grown to be gold (Au) nanoparticles of which the surface is a polyhedral shape in the reaction solution in order to achieve a thermodynamically stabilized crystal state. Here, the grown gold (Au) nanoparticles having a polyhedral shape may be a gold (Au) nanoparticle having an octahedral shape which is relatively stable in surface energy distribution as compared to other gold (Au) nanoparticles having other polyhedral shapes.

In the re-growing process (c), the reaction solution is preferably heated to a temperature of 0.9 $T_{b1}$ to 1.1 $T_{b1}$, based on a boiling point ($T_{b1}$, ° C.) of the reduction solvent. The reaction solution is heated to a temperature of 0.9 $T_{b1}$ to 1.1 $T_{b1}$, based on the boiling point ($T_{b1}$, ° C.) of the reducing solvent, such that an oxidation-reduction reaction is activated to smoothly perform the re-growing of the gold (Au) nanoparticles. As a specific example, the reaction solution may be heated to a temperature of 180° C. to 220° C. or more.

In addition, time required for heating the reaction solution is not significantly limited as long as the time is sufficient to apply sufficient energy to the reaction solution; however, heating the reaction solution for at least 30 minutes is preferred to secure the applying of sufficient energy, and heating the reaction solution for up to 3 hours is preferred to prevent unnecessary energy waste and to inhibit the side-reaction from being generated.

Meanwhile, the gold (Au) nanoparticle having a polyhedral shape manufactured by the above-described processes has an increased average diameter as compared to the gold (Au) nanoparticle having a polyhedral shape manufactured by 'the manufacturing process of the gold (Au) nanoparticles by heating the reaction solution (a)' which is the previous process, and therefore, it may be appreciated that the initially manufactured gold (Au) nanoparticles are grown.

Otherwise, according to another exemplary embodiment of a method of re-growing the spherical gold (Au) nanoparticles manufactured by the previous process, the re-growing of the gold nanoparticles may be performed by separately obtaining the spherical gold (Au) nanoparticles manufactured by the previous process and washing them, then, mixing the gold (Au) nanoparticles with a separate dispersion medium, and heating the dispersion medium containing the gold (Au) nanoparticles mixed thereto to apply energy required for growing the crystal.

Here, the separately obtaining of the gold (Au) nanoparticles may be performed by known methods such as filtering, centrifugation, and the like, without limitation, and the following washing process of the gold (Au) nanoparticles may be performed by using known solvents such as ethanol and the like, which are easy to wash the metal particles, without limitation.

In addition, the dispersion medium is not specifically limited as long as it is a liquid dispersion medium capable of uniformly dispersing the gold (Au) nanoparticles without reacting with the manufactured gold (Au) nanoparticles. As an example thereof, the dispersion medium is preferably any one selected from the group consisting of 1,5-pentanediol, 1,3-propanediol and diethylene glycol, or a mixed solution containing two or more kinds thereof.

Further, when heating the dispersion medium having the gold nanoparticles dispersed thereinto, the dispersion medium is preferably heated to a temperature of 1 $T_{b2}$ to 1.1 $T_{b2}$ based on the boiling point ($T_{b2}$, ° C.) of the dispersion medium. Here, when the above-described dispersion medium is heated to a temperature lower than the temperature range, energy required for the re-growth is not sufficiently applied, such that re-growing of the gold (Au) nanoparticles may not be smoothly achieved. Meanwhile, when the above-described dispersion medium is heated to the temperature range, and sufficient energy is applied to the gold (Au) nanoparticles, such that the spherical gold (Au) nanoparticles grow in a more stabilized crystal state. Accordingly, surprisingly, the spherical gold nanoparticles re-grow as gold (Au) nanoparticles of which the surface is a polyhedral shape in the reaction solution in order to obtain a thermodynamically stabilized crystal state. Here, the re-grown gold (Au) nanoparticles having a polyhedral shape may be a gold (Au) nanoparticle having an octahedral shape which is relatively stable in surface energy distribution as compared to other gold (Au) nanoparticles having other polyhedral shapes. As a specific example thereof, the heating temperature of the dispersion medium may be 242° C. to 265° C., and more specifically, 250° C. to 260° C.

Time required for heating the dispersion medium containing the gold (Au) nanoparticles dispersed thereinto is not significantly limited as long as the time is sufficient to apply sufficient energy to the dispersion medium; however, heating the dispersion medium for at least 1 hour is preferred to secure applying of sufficient energy, and heating the reaction solution for up to 20 hours is preferred to prevent unnecessary energy waste and to inhibit the side-reaction from being generated. As a specific example thereof, the heating time may be 10 to 20 hours.

In addition, the heating of the dispersion medium is preferably performed in a state in which the stirring is not performed, that is, the gold (Au) nanoparticles are capable of being grown only by applying heat energy through the heating without stirring, and when the heating and the stirring are simultaneously performed, the uniform gold (Au) nanoparticles may be prevented from being grown.

Meanwhile, the gold (Au) nanoparticle having a polyhedral shape manufactured by the above-described processes has an increased average diameter as compared to the gold (Au) nanoparticle having a polyhedral shape manufactured by 'the manufacturing process of the gold (Au) nanoparticles by heating the reaction solution (a)' which is the previous process, and therefore, it may be appreciated that the initially manufactured gold (Au) nanoparticles are grown.

Then, the re-grown gold (Au) nanoparticles having a polyhedral shape are secondarily etched to be a spherical gold (Au) nanoparticle. Specifically, the secondary etching of the gold (Au) nanoparticles as described above may be performed by secondarily and additionally injecting the gold precursor into the reaction solution containing the gold (Au) nanoparticles having a polyhedral shape manufactured by the previous process, followed by the reaction.

More specifically, the gold precursor is directly reduced to produce the gold (Au) nanoparticles like the manufacturing process (a) or the primary etching process (b) as described above, and is a raw material directly involved in the growth or the etching reaction of the manufactured gold (Au) nanoparticles, and includes any appropriate materials without limitation as long as the material is dissociated in the reaction solution to form $AuCl_4^-$ ions. As an example thereof, tetrachloroauric (III) acid ($HAuCl_4$) is preferred to secure yield of the gold (Au) nanoparticles reproducible after the process.

When the gold precursor is secondarily and additionally injected into the reaction solution, and left for a predetermined time or more, spherical gold (Au) nanoparticles in which a protruding region of an apex or an edge portion of the surface of the gold (Au) nanoparticles having a polyhedral shape is etched may be manufactured.

Here, in order to increase efficiency of the etching reaction, the secondary and additional injection of the gold precursor may be simultaneously performed with the stirring of the reaction solution, wherein the starting and ending time of the stirring are not significantly limited; but it is preferable to perform continuous stirring from prior to the secondary and additional injection of the precursor until the time when the etching process is terminated, for an effective etching process. The etching reaction is preferably performed by additionally injecting 20 to 30 parts by weight of the gold precursor based on 100 parts by weight of the gold precursor of the manufacturing process (a) into the reaction solution for at least 10 to 20 hours, and preferably, for 15 to 20 hours, wherein it is preferred to continuously perform the etching and the stirring.

That is, in the etching reaction, the gold precursor is secondarily and additionally injected while stirring the reaction solution, and the secondarily and additionally injected gold precursor is reacted with the gold (Au) nanoparticles having a polyhedral shape manufactured by the previous process for a predetermined time to manufacture the spherical gold (Au) nanoparticles.

Meanwhile, the gold (Au) nanoparticle having a polyhedral shape manufactured by the above-described processes has an increased average diameter as compared to the spherical gold (Au) nanoparticle manufactured by 'the primary etching process of the gold (Au) nanoparticles (b)' which is the previous process, and therefore, it may be appreciated that the gold (Au) nanoparticles are grown.

In the above-described process, one unit process consisting of the re-growing process (c) and the secondary etching process (d) may be performed one or more times to manufacture the spherical gold (Au) nanoparticles. Here, as the one unit process is repeatedly performed, the size of the manufactured gold (Au) nanoparticles is grown, such that the size of the gold (Au) nanoparticles to be obtained may be controlled, and when repeatedly performing the one unit process at least four times, the spherical gold (Au) nanoparticles having a size of 200 nm or more may be manufactured.

According to the manufacturing method of the spherical gold (Au) nanoparticles as described above, the manufactured gold (Au) nanoparticles are spherical gold (Au) nanoparticles having a diameter of 100 nm or more, and are pure gold (Au) nanoparticles without containing components rather than the gold therein, and specifically, the gold component contained in the gold (Au) nanoparticles has a purity of 99.9% or more.

As described above, the spherical gold (Au) nanoparticles having significantly high purity may be manufactured, and the thus-manufactured gold (Au) nanoparticles have significant excellence in view of optical and thermal stability.

Hereinafter, specific examples and comparative examples of a manufacturing method of spherical gold (Au) nanoparticles according to the present invention, and spherical gold (Au) nanoparticles manufactured by using the same are provided. However, the specific examples and comparative examples are provided by experimentally demonstrating the excellence of the present invention, and thus, the present invention is not limited to the experimental examples and comparative examples.

EXAMPLE 1

20 mL of ethylene glycol was injected into a vial and stirred. 0.4 mL of poly(dimethyldiallylammonium chloride) aqueous solution (SIGMA-ALDRICH, CAS Number 26062-79-3, 20 wt % in $H_2O$, density: 1.04 g/mL) and 0.8 mL of 1M $H_3PO_4$ aqueous solution were additionally added to the stirred ethylene glycol to prepare a reaction solution. 0.02 mL of a 0.5M $HAuCl_4$ precursor aqueous solution was added to the reaction solution, followed by stirring at room temperature for 15 minutes. Then, the stirring was stopped, and the vial containing the reaction solution was left at 195° C. for 30 minutes. After being left, the reaction solution was cooled to room temperature.

Then, 10 mL of ethanol was injected into the reaction solution cooled to room temperature, followed by centrifugation at a speed of 13,000 rpm for 5 minutes, to remove an excessive amount of reaction product and by-products. The centrifugation process was repeated three times to obtain a precipitate.

EXAMPLE 2

The reaction solution cooled to room temperature before the centrifugation was performed in Example 1 above was used in Example 2. 0.005 mL of 0.5M $HAuCl_4$ precursor aqueous solution was further added thereto while stirring the reaction solution. The stirring state was maintained at room temperature for 2 hours.

Then, 10 mL of ethanol was injected into the stirred reaction solution, followed by centrifugation at a speed of 13,000 rpm for 5 minutes, to remove an excessive amount of reaction product and by-products. The centrifugation process was repeated three times to obtain a precipitate.

EXAMPLE 3

The reaction solution cooled to room temperature before the centrifugation was performed in Example 1 above was used in Example 3. 0.005 mL of 0.5M $HAuCl_4$ precursor aqueous solution was further added thereto while stirring the reaction solution. The stirring state was maintained at room temperature for 12 hours.

Then, 10 mL of ethanol was injected into the stirred reaction solution, followed by centrifugation at a speed of 13,000 rpm for 5 minutes, to remove an excessive amount of reaction product and by-products. The centrifugation process was repeated three times to obtain a precipitate.

EXAMPLE 4

The reaction solution cooled to room temperature before the centrifugation was performed in Example 1 above was used in Example 4. 0.005 mL of 0.5M $HAuCl_4$ precursor aqueous solution was further added thereto while stirring the reaction solution. The stirring state was maintained at room temperature for 20 hours.

Then, 10 mL of ethanol was injected into the stirred reaction solution, followed by centrifugation at a speed of 13,000 rpm for 5 minutes, to remove an excessive amount of reaction product and by-products. The centrifugation process was repeated three times to obtain a precipitate.

EXAMPLE 5

The stirred reaction solution before the centrifugation was performed in Example 4 above was used in Example 5. The reaction solution was heated at 195° C. for 1 hour. The stirring was not performed during the heating process.

EXAMPLE 6

Example 6 was performed by using the reaction solution heated in Example 5 above and conducting the same method as Example 4.

Specifically, 0.005 mL of 0.5M $HAuCl_4$ precursor aqueous solution was further added thereto while stirring the reaction solution. The stirring state was maintained at room temperature for 20 hours.

Then, 10 mL of ethanol was injected into the stirred reaction solution, followed by centrifugation at a speed of 13,000 rpm for 5 minutes, to remove an excessive amount of reaction product and by-products. The centrifugation process was repeated three times to obtain a precipitate.

EXAMPLE 7

The stirred reaction solution before the centrifugation was performed in Example 6 above was used in Example 7. The reaction solution was heated at 195° C. for 1 hour. The stirring was not performed during the heating process.

EXAMPLE 8

Example 8 was performed by using the reaction solution heated in Example 7 above, and repeatedly performing the processes of Examples 6 and 7 six times.

EXAMPLE 9

A precipitate obtained from Example 4 above was washed with ethanol 1 or more times. The precipitate from which the reaction product and by-products were removed was injected into 20 mL of 1,5-pentadiol (1,5-pentanediol), followed by re-dispersion. The re-dispersed reaction solution was heated at 250° C. for 12 hours. The stirring was not performed during the heating process.

EXAMPLE 10

The precipitate of Example 1 above was injected into 20 mL of ethylene glycol, followed by re-dispersion. 0.04 mL of hexadecyltrimethylammonium bromide (20 wt % in $H_2O$) and 0.005 mL of a 0.5M $HAuCl_4$ precursor aqueous solution were injected into the solution. The solution was stirred to room temperature for 20 hours.

COMPARATIVE EXAMPLE 1

The precipitate of Example 1 above was injected into 20 mL of ethylene glycol, followed by re-dispersion. 0.04 mL of polyvinylpyrrolidone (20 wt % in $H_2O$) and 0.005 mL of a 0.5M $HAuCl_4$ precursor aqueous solution were injected into the solution. The solution was stirred to room temperature for 20 hours.

COMPARATIVE EXAMPLE 2

The precipitate of Example 1 above was injected into 20 mL of ethylene glycol, followed by re-dispersion. 0.04 mL of sodium dodecyl sulfate (20 wt % in $H_2O$) and 0.005 mL of a 0.5M $HAuCl_4$ precursor aqueous solution were injected into the solution. The solution was stirred to room temperature for 20 hours.

Hereinafter, experimental examples according to examples and comparative examples of the present invention are provided. However, the specific examples are provided by experimentally demonstrating the excellence of the present invention, and thus, the present invention is not limited to the experimental exemplary embodiments and experimental examples.

EXPERIMENTAL EXAMPLE 1

FIGS. 2*a* to 2*d* are scanning electron microscope (SEM) photographs of the gold (Au) nanoparticles manufactured by Examples 1 to 4 in sequence. As a result obtained by observing microscopic forms of the gold (Au) nanoparticles manufactured by the present invention with reference to FIG. 2, it could be confirmed that the gold (Au) nanoparticles having an octahedral shape manufactured in Example 1 were changed into the spherical gold (Au) nanoparticles through processes of Examples 2 to 4.

Specifically, when observing sizes of the gold (Au) nanoparticles after performing the etching process for 2 hours in Example 2, for 12 hours in Example 3, and 20 hours in Example 4 by using the same gold (Au) nanoparticles having the octahedral shape of Example 1, it could be confirmed that the gold (Au) nanoparticles of Example 1 had an average particle size of 135.4±12.5 nm; meanwhile, the gold (Au) nanoparticles of Example 2 had an average particle size of 126.9±10.9 nm, and the gold (Au) nanoparticles of Example 3 had an average particle size of 118.2±9.1 nm, and the gold (Au) nanoparticles of Example 4 had an average particle size of 112.3±8.2 nm. Accordingly, it could be appreciated that as the etching reaction time is increased, the size of the initially manufactured gold (Au) nanoparticles becomes gradually decreased.

In addition, as a result obtained by reviewing the shapes of the gold (Au) nanoparticles after performing the etching process, respectively, with reference to FIG. 2, it could be confirmed that the gold (Au) nanoparticles of Example 1 had a clearly octahedral shape; meanwhile, the gold (Au) nanoparticles of Examples 2 and 3 had an unspecific octahedral shape, and the gold (Au) nanoparticles of Example 4 had a clearly spherical shape.

That is, it could be appreciated from FIG. 2 that at the time of manufacturing the gold (Au) nanoparticles according to the present invention, the gold (Au) nanoparticles having a spherical shape could be manufactured by maintaining time for the etching process of the initially manufactured gold (Au) nanoparticles to be a predetermined time or more to gradually etch the gold (Au) nanoparticles.

EXPERIMENTAL EXAMPLE 2

Figure 3:
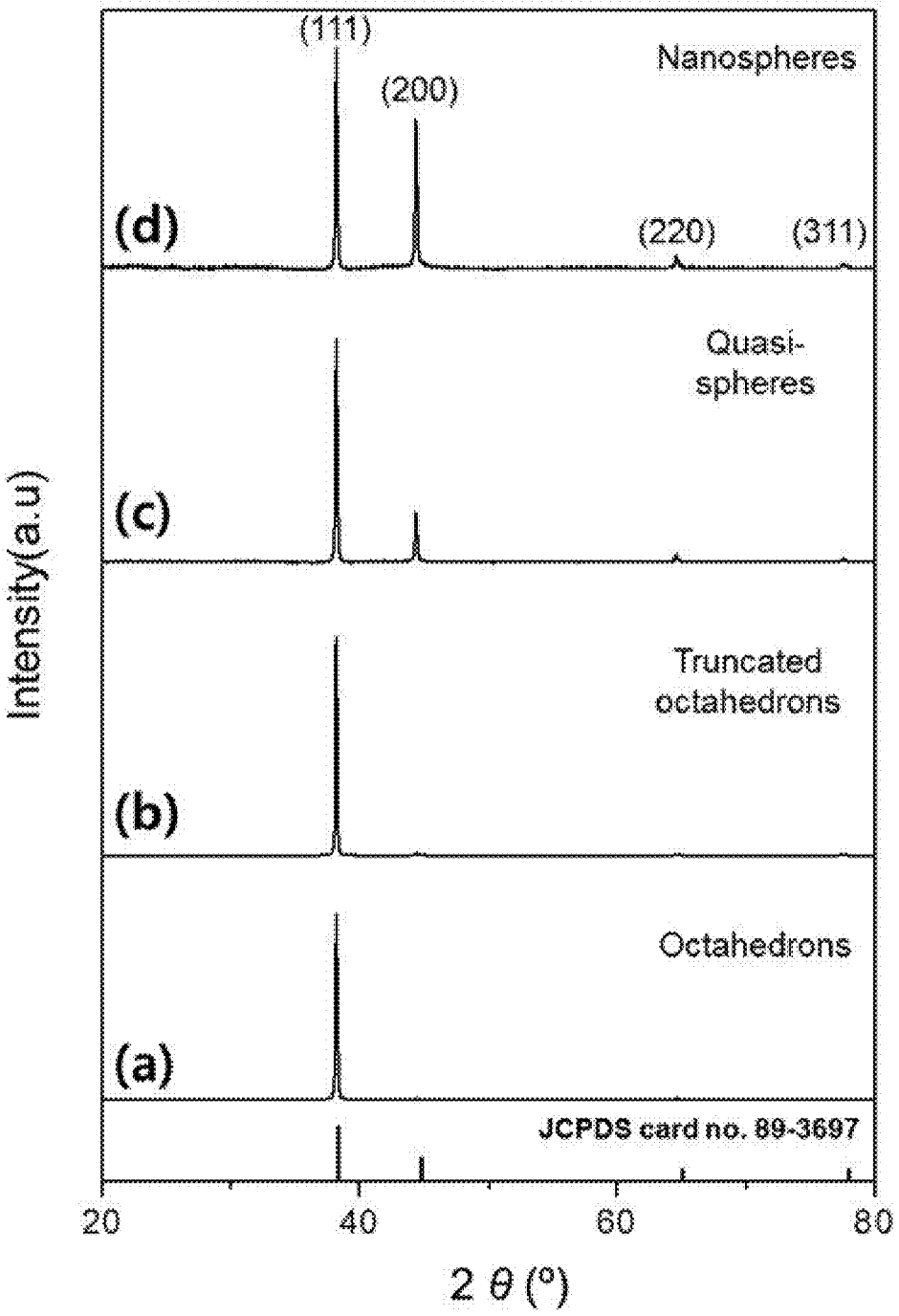
FIG. 3 are X-ray diffraction (XRD) pattern of gold (Au) nanoparticles manufactured by Examples 1 to 4 in sequence.

FIG. 3 are X-ray diffraction (XRD) pattern of the gold (Au) nanoparticles manufactured by Examples 1 to 4 in sequence. It could be appreciated from FIG. 3 that when confirming crystal phases of the gold (Au) nanoparticles of Examples 1 to 4, all of the gold (Au) nanoparticles of Examples 1 to 4 had a face-centered cubic crystal structure.

Meanwhile, it could be confirmed that a crystal face of the gold (Au) nanoparticles of Example 1 consists of {111} face, a crystal face of the gold (Au) nanoparticles of Example 2 consists of {111} and {200} faces, a crystal face of the gold (Au) nanoparticles of Example 3 consists of {111}, {200}, and {220} faces, and a crystal face of the gold (Au) nanoparticles of Example 4 consists of {111}, {200}, {220} and {311} faces, such that the crystal faces of the gold (Au) nanoparticles of Examples 1 to 4 were formed in sequence, and it could be confirmed from FIG. 2 that Example 4 of which the gold (Au) nanoparticles visibly had spherical shape is identical to a standard material gold JCPDS card no. 89-3697.

That is, it could be appreciated that when the octahedral shaped nanoparticle consisting of {111} face of Example 1 became gradually etched as the etching process was performed for 20 hours like Example 4, the octahedral shaped nanoparticle was changed into the spherical gold (Au) nanoparticle.

EXPERIMENTAL EXAMPLE 3

Figure 4:
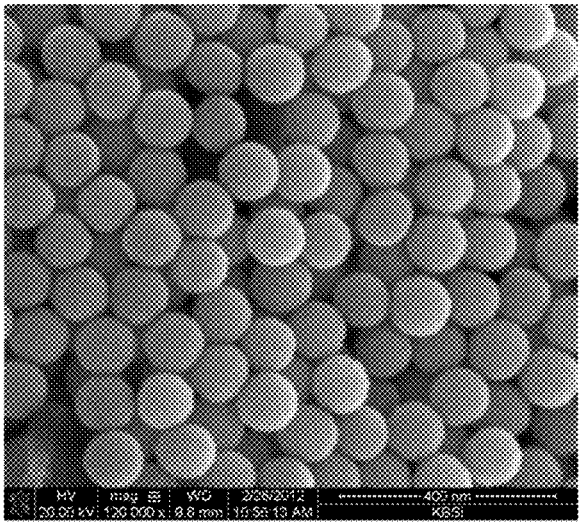
FIG. 4 is a scanning electron microscope (SEM) photograph of the gold (Au) nanoparticle manufactured by Example 4 in sequence.

FIG. 4 is a scanning electron microscope (SEM) photograph of the gold (Au) nanoparticle manufactured by Example 4.

In Example 4, the gold (Au) nanoparticles was obtained by containing 0.4 mL of poly(dimethyldiallylammonium chloride) which is the cationic surfactant and performing the manufacturing method of the present invention. It was shown from results of FIG. 4 that the cationic surfactant is preferably contained in 500 to 3000 parts by weight based on 100 parts by weight of the gold precursor of the solution reaction, and more preferably, 1000 to 2800 parts by weight, and even more preferably, 1500 to 2500 parts by weight.

In addition, it could be confirmed that as the amount of the cationic surfactant is proportional to degree of etching process of the gold (Au) nanoparticles in the manufacturing method of the gold (Au) nanoparticles, the amount of the cationic surfactant is an important factor in controlling the level or the speed of the etching process in an etching mechanism.

EXPERIMENTAL EXAMPLE 4

Figure 5A:
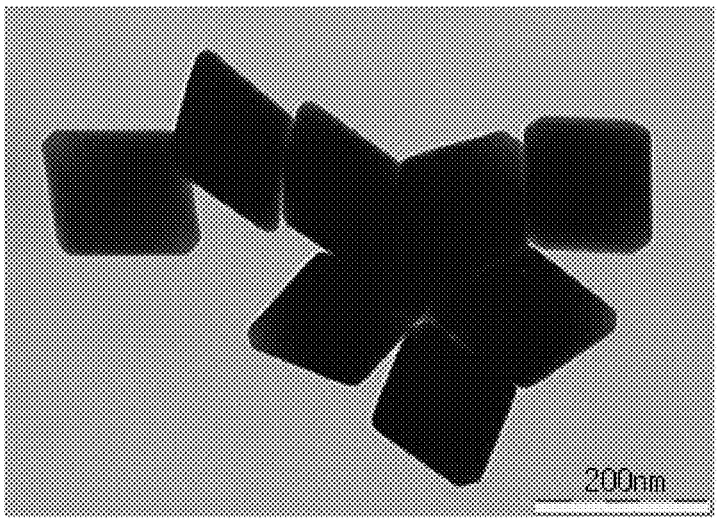
FIGS. 5*a* to 5*c* are transmission electron microscope (TEM) photographs of gold (Au) nanoparticles manufactured by Comparative Examples 1 and 2, and Example 10 in sequence.
Figure 5B:
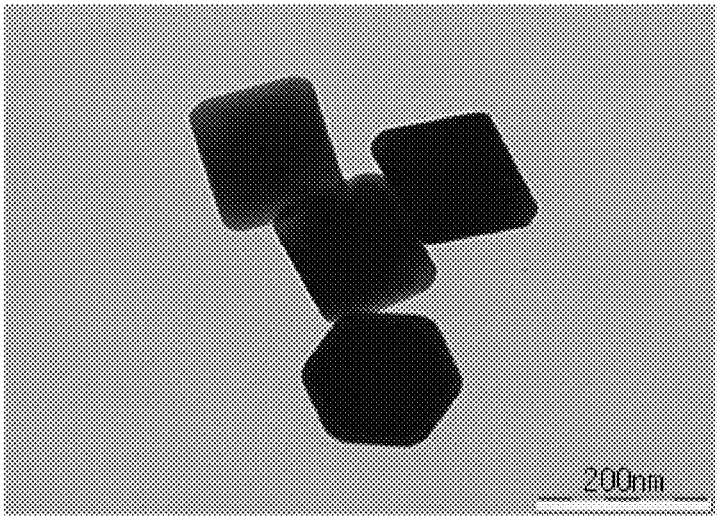
Figure 5C:
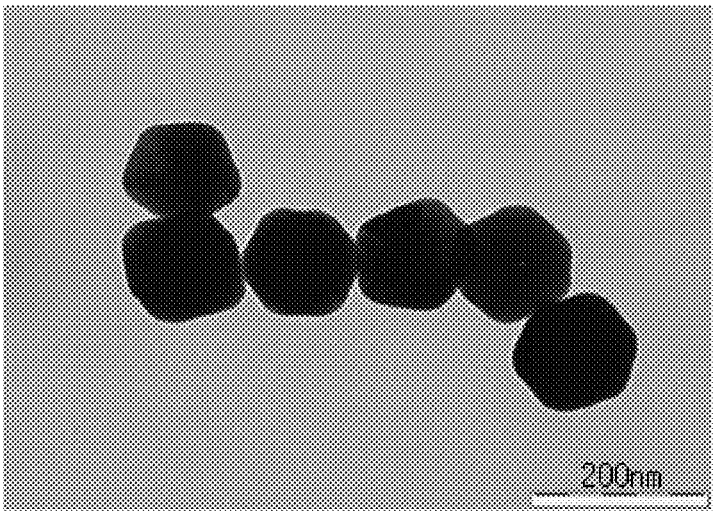
Figure 6A:
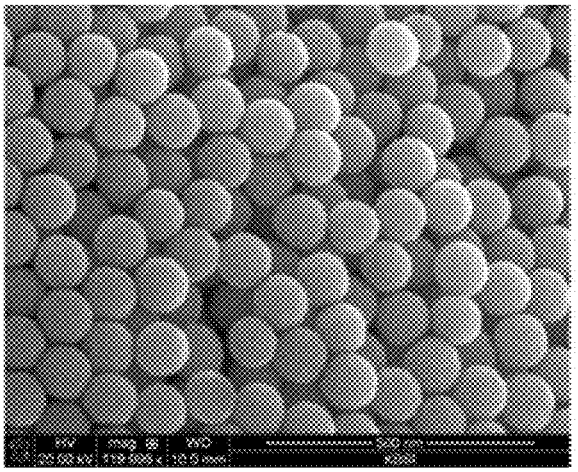
FIGS. 6*a* to 6*d* are scanning electron microscope (SEM) photographs of gold (Au) nanoparticles manufactured by Examples 4 to 7 in sequence.
Figure 6B:
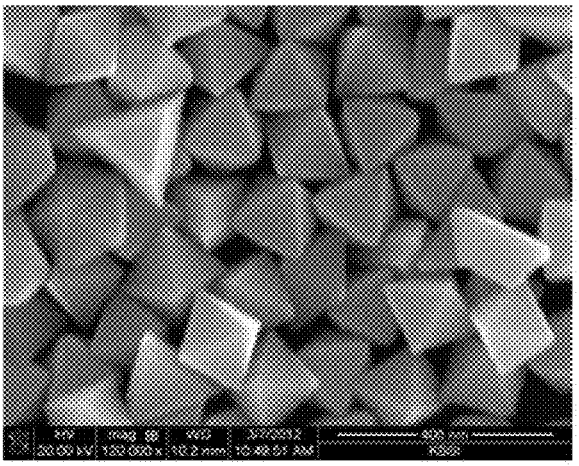
Figure 6C:
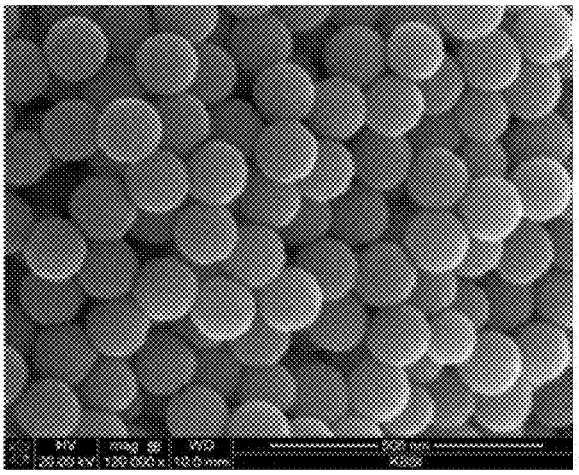
Figure 6D:
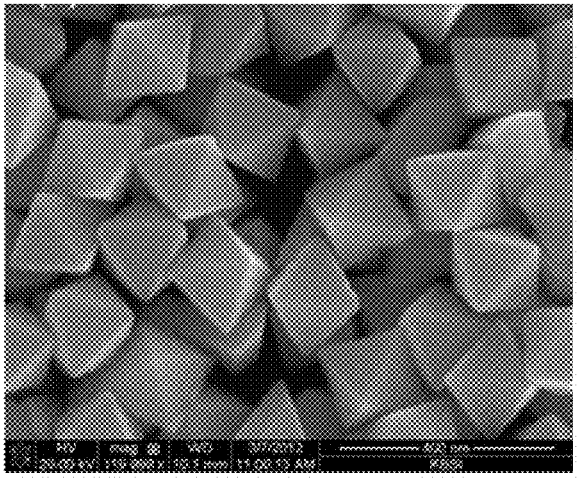
Figure 7A:
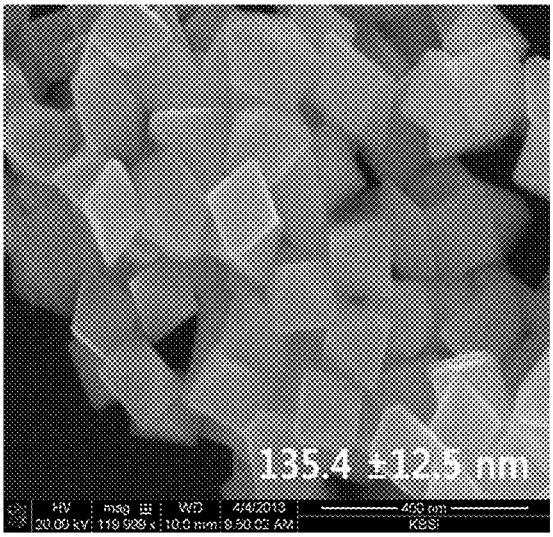
FIGS. 7*a* to 7*l* are sequential scanning electron microscope (SEM) photographs of gold (Au) nanoparticles manufactured by Example 8.
Figure 7B:
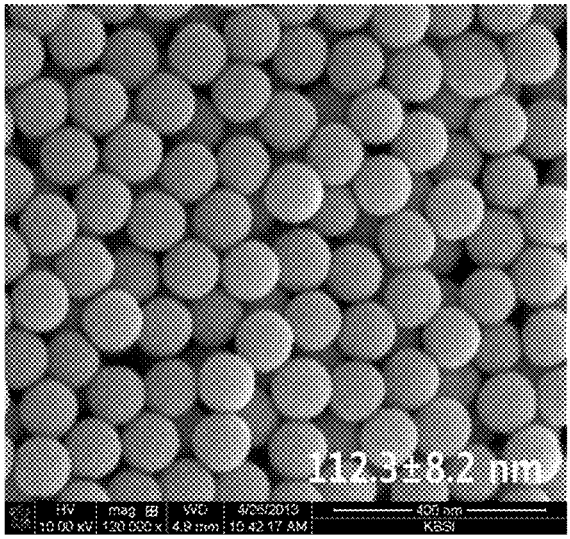
Figure 7C:
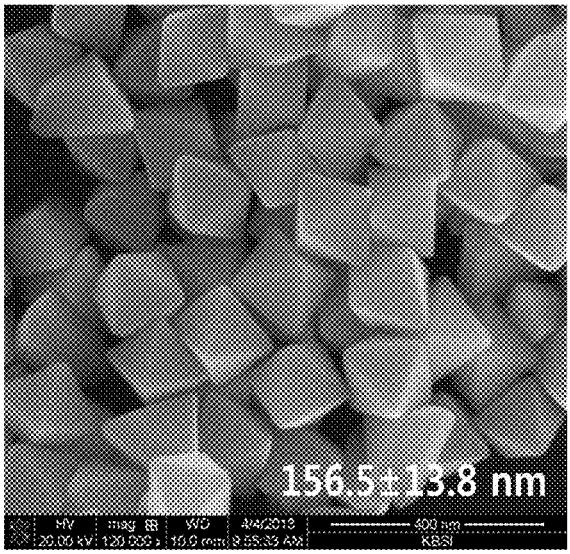
Figure 7D:
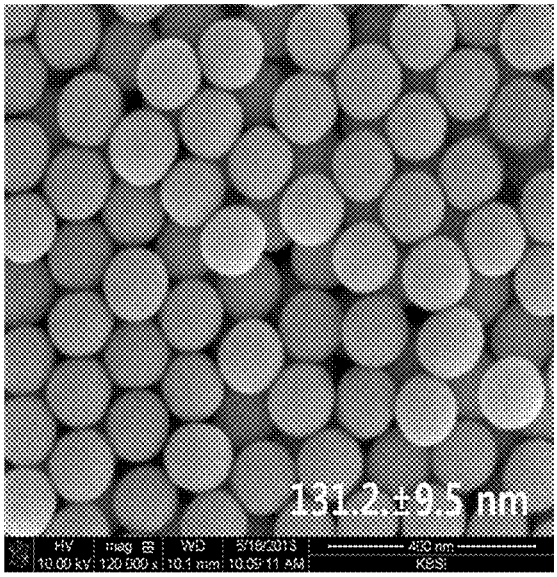
Figure 7E:
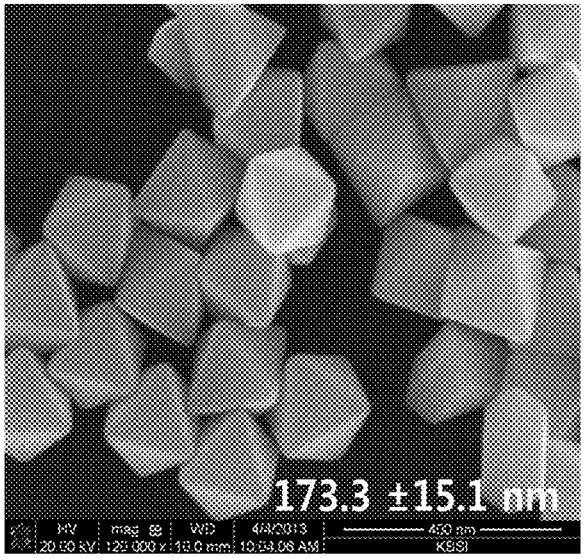
Figure 7F:
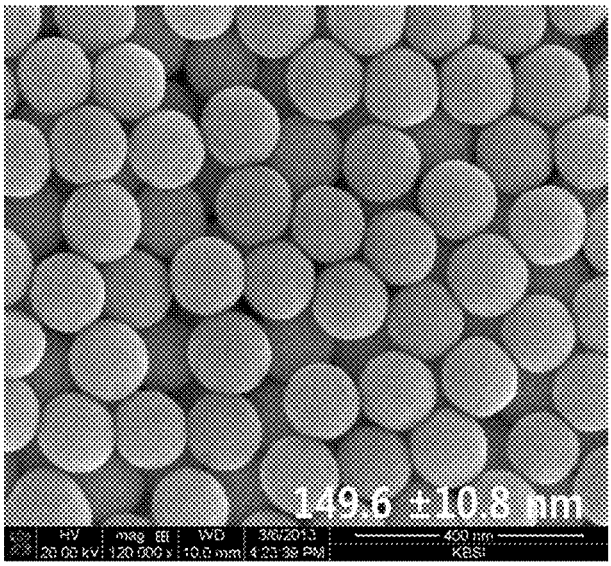
Figure 7G:
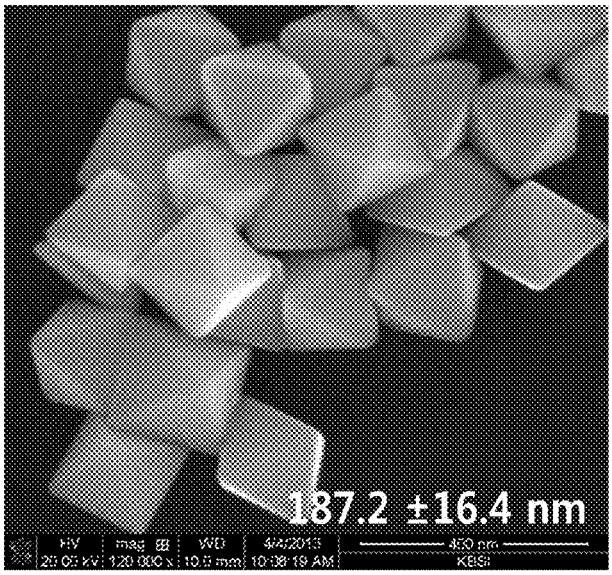
Figure 7H:
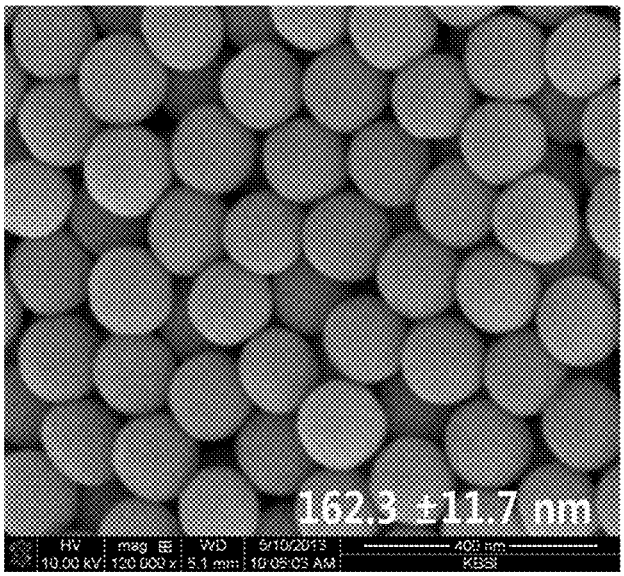
Figure 7I:
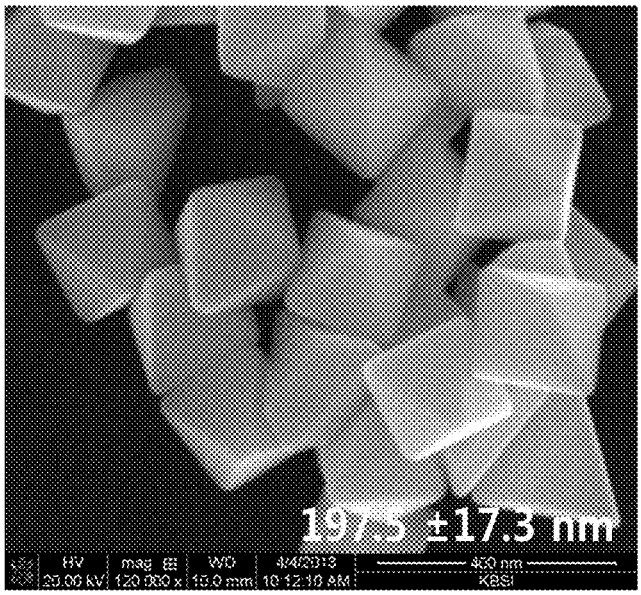
Figure 7J:
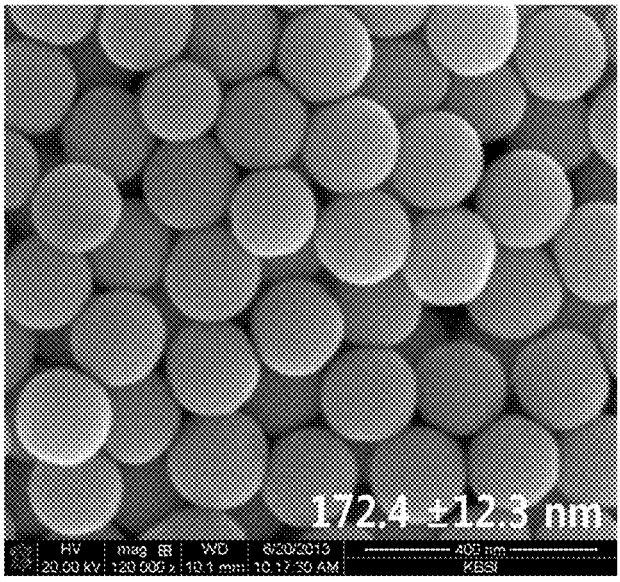
Figure 7K:
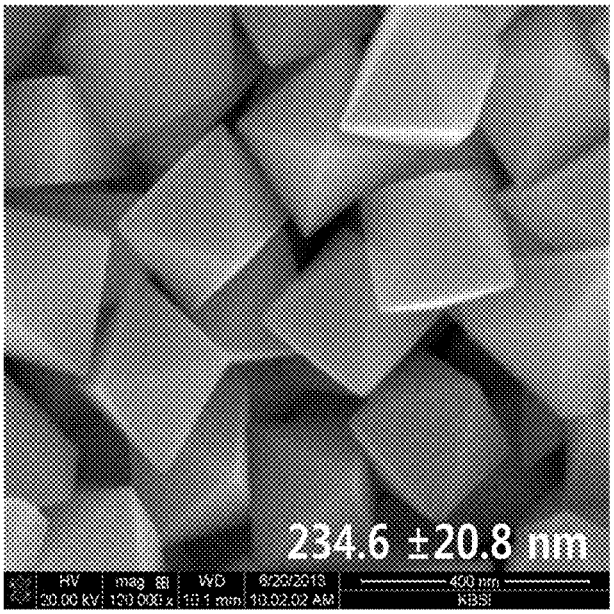
Figure 7L:
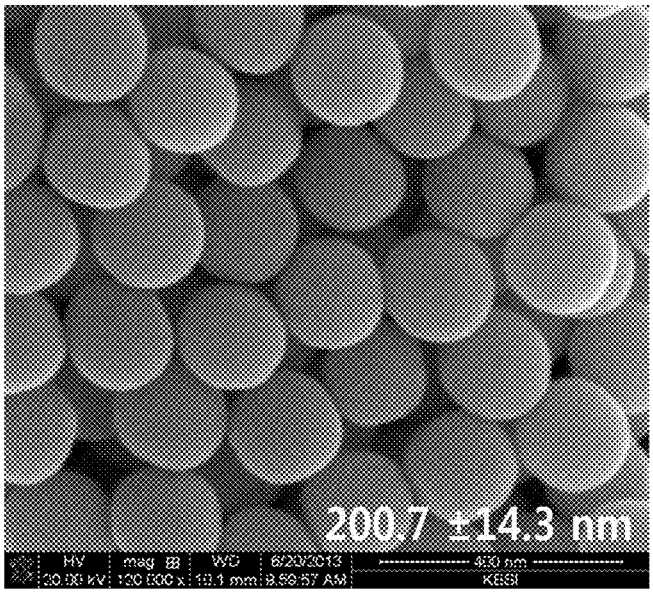

FIGS. 5*a* to 5*c* are transmission electron microscope (TEM) photographs of the gold (Au) nanoparticles manufactured by Comparative Examples 1 and 2, and Example 10 in sequence.

In Comparative Example 1, gold (Au) nanoparticles were obtained by performing the same method according to the present invention except for containing non-ionic surfactant. In Comparative Example 2, gold (Au) nanoparticles were obtained by performing the same method according to the present invention except for containing anionic surfactant. In Comparative Example 10, gold (Au) nanoparticles were manufactured by containing the cationic surfactant according to the present invention.

It could be confirmed that when comparing the gold (Au) nanoparticles in view of a shape with reference to FIG. 5, the degree of etching process was increased in a sequence of Comparative Examples 1 and 2, and Example 10, and specifically, the etching of the gold (Au) nanoparticles was not conducted in the case of manufacturing the gold (Au) nanoparticles by containing polyvinylpyrrolidone being the non-ionic surfactant or sodium dodecyl sulfate being the anionic surfactant, but the etching of the gold (Au) nanoparticles was conducted only in the case of manufacturing the gold (Au) nanoparticles by containing hexadecyltrimethylammonium bromide being the cationic surfactant.

That is, the etching process was achieved only in the gold (Au) nanoparticles of Examples 2 and 10 manufactured by containing poly(dimethyldiallylammonium chloride) and hexadecyltrimethylammonium bromide which are cationic surfactants. Therefore, it could be appreciated that the cationic surfactant functions as an important factor of generating oxidation of the gold (Au) nanoparticles while forming a complex with $AuCl_4^-$ in the etching process.

EXPERIMENTAL EXAMPLE 5

FIGS. 6*a* to 6*d* are scanning electron microscope (SEM) photographs of gold (Au) nanoparticles manufactured by Examples 4 to 7 in sequence, and FIGS. 7*a* to 7*l* are sequential scanning electron microscope (SEM) photographs of gold (Au) nanoparticles manufactured by Example 8.

Example 4 is the spherical gold (Au) nanoparticle manufactured by the present invention, and Example 5 is the gold (Au) nanoparticle having an octahedral shape re-grown by using the gold (Au) nanoparticles of Example 4 as a seed. Here, the gold (Au) nanoparticles of Example 5 had an average size of 156.5±13.8 nm, which was confirmed that the gold (Au) nanoparticles of Example 5 were grown as compared to the gold (Au) nanoparticles of Example 1 which are the initially synthesized gold (Au) nanoparticles having an average size of 135.4±12.5 nm.

In addition, in Example 6, the spherical gold (Au) nanoparticle manufactured by using the gold (Au) nanoparticles having the octahedral shapes of Example 5 were obtained. Here, it could be confirmed that the gold (Au) nanoparticles of Example 6 had an average size of 131.2±9.5 nm, which was slightly decreased as compared to the gold (Au) nanoparticles of Example 5, and the surface was etched, and in addition, the gold (Au) nanoparticles of Example 6 were more grown than that of Example 4 having an average size of 112.3±8.2 nm used as the seed of Example 6.

In addition, in Example 7, the octahedral shaped gold (Au) nanoparticles re-grown by using the spherical gold (Au) nanoparticles of Example 6 as a seed were obtained. Here, it could be confirmed that the gold (Au) nanoparticles of Example 7 had an average size of 173.3±15.1 nm, and therefore, the gold (Au) nanoparticles of Example 7 were more grown as compared to the gold (Au) nanoparticles of Example 6 having an average size of 131.2±9.5 nm used as a seed.

Meanwhile, when using the gold (Au) nanoparticles of Example 7 as described above as a seed, and repeating the etching process of Example 6 and the re-growing process of Example 7 several times, gold (Au) nanoparticles having a size of 200 nm or more may be synthesized.

As an example thereof, a result of the spherical gold nanoparticles of Example 8 manufactured by using the gold (Au) nanoparticles having an octahedral shape manufactured by Example 5, repeating the process of Example 6 and Example 7 four times, and performing the process of Example 6 once again was shown in FIG. 7. Specifically, FIG. 7*a* shows a result of Example 1, FIG. 7*b* shows a result of Example 4, FIG. 7*c* shows a result of Example 5, FIG. 7*d* shows a result of Example 6, FIG. 7*e* shows a result of Example 7, FIG. 7*f* shows a result of Example 6 using e), FIG. 7*g* shows a result of Example 7 using f), FIG. 7*h* shows a result of Example 6 using g), FIG. 7*i* shows a result of Example 7 using h), FIG. 7*j* shows a result of Example 6 using i), FIG. 7*k* shows a result of Example 7 using j), and FIG. 7*l* shows a result of Example 6 using k).

That is, it could be appreciated from FIG. 7 that when repeating the etching process of Example 6 and the re-growing process of Example 7 several times, uniformly spherical gold (Au) nanoparticles of which size was grown could be synthesized as compared to the gold (Au) nanoparticles manufactured from the previous process.

EXPERIMENTAL EXAMPLE 6

Figure 8:
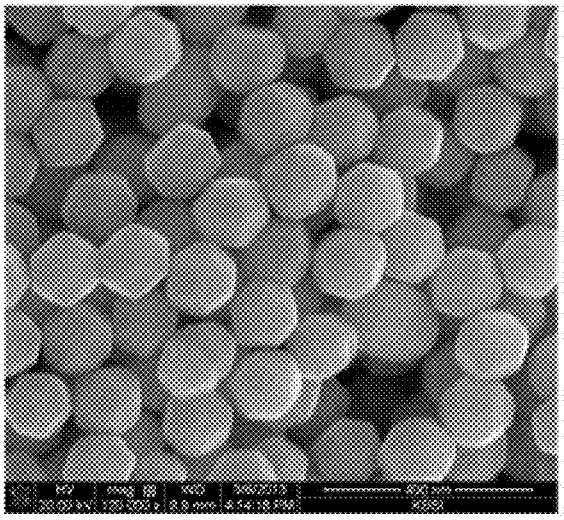
FIG. 8 is a scanning electron microscope (SEM) photograph of a gold (Au) nanoparticle manufactured by Example 9.

FIG. 8 is a scanning electron microscope (SEM) photograph of the gold (Au) nanoparticle manufactured by Example 9.

In Example 9, gold (Au) nanoparticles having a polyhedral shape manufactured by using the spherical gold (Au) nanoparticles of Example 4 manufactured by the present invention were obtained. It could be confirmed from FIG. 8 that the crystal of the gold (Au) nanoparticles manufactured at 250° C. which is a boiling point of 1,5-pentane diol which is a dispersion liquid according to Example 9 was grown to be gold (Au) nanoparticle having a polyhedral shape and provided with a protruding portion formed on a surface thereof. It could be confirmed that in Example 9, sufficient energy was applied to grow the spherical gold (Au) nanoparticles to have an angled shape, such that the surface of the gold (Au) nanoparticles was re-grown to be a polyhedral shape.

EXPERIMENTAL EXAMPLE 7

Figure 9A:
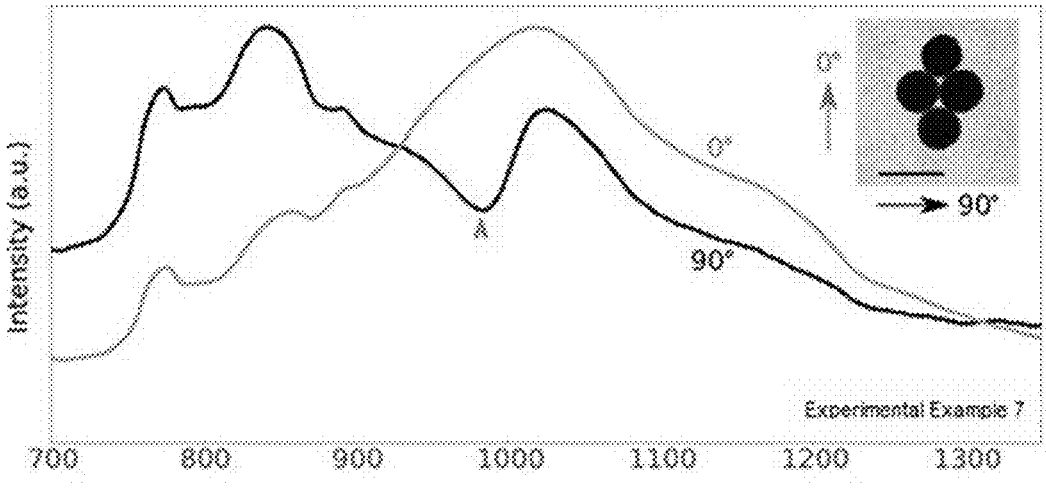
FIG. 9*a* is a scattering spectrum of the gold (Au) nanoparticle manufactured by Example 4.
Figure 9B:
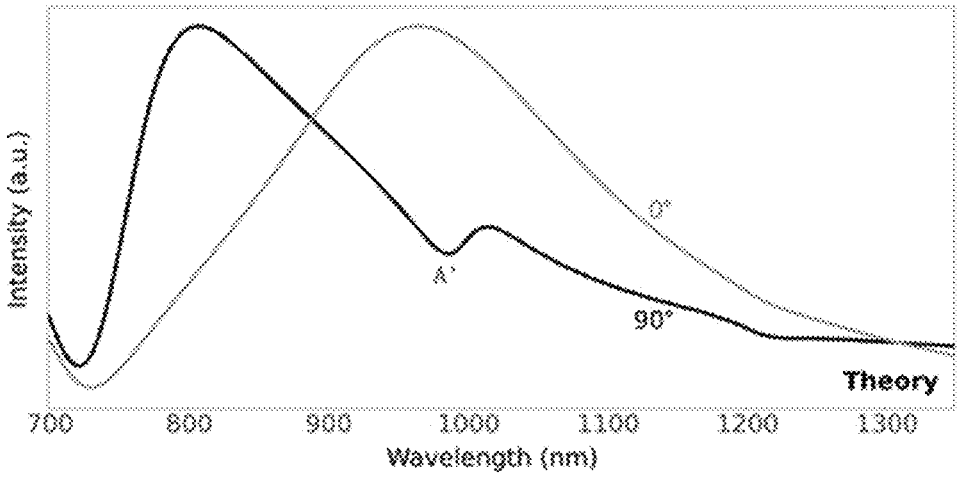
FIG. 9*b* is a theoretically calculated scattering spectrum of the gold (Au) nanoparticle.

FIG. 9*a* is a scattering spectrum of the gold (Au) nanoparticles manufactured by Example 4, and FIG. 9*b* is a theoretically calculated scattering spectrum of the gold (Au) nanoparticles manufactured by Example 4.

Specifically, FIG. 9*a* shows a result obtained by observing optical properties of the gold (Au) nanoparticles by assembling the gold (Au) nanoparticles manufactured by Example 4 to have a cluster shape, observing the assembled gold (Au) nanoparticles by transmission electron microscope (TEM) spectrum and measuring the scattering spectrum.

As shown in FIG. 9*a*, in a 90 degree direction parallel to a direction of a short axis in the cluster shape, a minimum peak (A) of the spectrum was observed around 980 nm. The peak (A) disappeared in a 0 degree direction parallel to a direction a long axis in the cluster shape. The optical property refers to Fano-like resonance, and this tendency is similar to the tendency of the peak (A') of the scattering spectrum calculated by theoretically computational stimulation based on the spherical shaped model of FIG. 9*b*.

That is, it could be confirmed from FIG. 9 that the spherical gold (Au) nanoparticles manufactured by Example 4 of the present invention had a completely spherical shape.

With the manufacturing method of spherical gold (Au) nanoparticles according to the present invention, the gold (Au) nanoparticles having excellent quality and uniformity and a size of 100 nm or more may be manufactured by a simplified process. At the same time, with the manufacturing method of the spherical gold (Au) nanoparticles according to the present invention, pure gold (Au) nanoparticles having a size of 100 nm or more may be manufactured.

Further, with the manufacturing method of the spherical gold (Au) nanoparticles according to the present invention, the optically and thermally stable and uniformly spherical gold nanoparticle having a size of 100 nm or more may be manufactured by using a cation-based surfactant.

In addition, gold (Au) nanoparticles having various shapes and sizes manufactured by the manufacturing method of the present invention may be provided, and the manufactured gold (Au) nanoparticles may be significantly excellent in view of optical and thermal stability to be industrially utilized.

Hereinabove, although the present invention is described by specific matters, limited exemplary embodiments, and drawings, they are provided only for assisting in the entire understanding of the present invention. Therefore, the present invention is not limited to the exemplary embodiments. Various modifications and changes may be made by those skilled in the art to which the present invention pertains from this description.

Therefore, the spirit of the present invention should not be limited to the above-described exemplary embodiments, and the following claims as well as all modified equally or equivalently to the claims are intended to fall within the scopes and spirit of the invention.

What is claimed is:

1. A manufacturing method of spherical gold (Au) nanoparticles comprising:

(a) manufacturing gold (Au) nanoparticles by heating a reaction solution containing a gold precursor, a cationic surfactant, an inorganic acid, and a reducing solvent;

(b) primarily etching the gold (Au) nanoparticles by cooling the reaction solution to room temperature and additionally injecting the gold precursor into the reaction solution;

(c) re-growing the gold (Au) nanoparticles to have a polyhedral shape by heating the reaction solution; and (d) secondarily etching the gold (Au) nanoparticles by cooling the reaction solution to room temperature and additionally injecting the gold precursor into the reaction solution.

2. The manufacturing method of claim 1, wherein in the primary etching of the gold (Au) nanoparticles (b) or the secondary etching of the gold (Au) nanoparticles (d), the etching is performed for 15 to 20 hours.

3. The manufacturing method of claim 1, wherein the re-growing of the gold (Au) nanoparticles (c) includes:

forming a dispersion liquid by mixing the gold (Au) nanoparticles separated and obtained from the primary etching of the gold (Au) nanoparticles (b) with a dispersion medium consisting of any one selected from the group consisting of 1,5-pentanediol, 1,3-propanediol and diethylene glycol, or a mixed solution containing two or more kinds thereof; and re-growing the gold (Au) nanoparticles to have a polyhedral shape by heating the reaction solution.

4. The manufacturing method of claim 1, wherein the gold precursor is $HAuCl_4$.

5. The manufacturing method of claim 1, wherein the reducing solvent is any one selected from the group consisting of ethylene glycol, diethylene glycol, triethylene glycol, tetraethylene glycol, polyethylene glycol, propylene glycol, dipropylene glycol, polypropylene glycol, hexylene glycol and 1,2-hexadecanediol, or glycol ether solvents including methyl glycol, butyl glycol, butyl triglycol, butyl polyglycol, hexyl glycol, hexyl diglycol, ethyl hexyl glycol, ethyl hexyl diglycol, aryl glycol, phenyl glycol, phenyl diglycol, benzyl glycol, methyl propylene glycol, methyl propylene diglycol, methyl propylene triglycol, propyl propylene glycol, propyl propylene diglycol, butyl propylene glycol, butyl propylene diglycol, phenyl propylene glycol, and methyl propylene glycol acetate, or a mixture containing two or more kinds thereof.

6. The manufacturing method of claim 1, wherein the cationic surfactant is any one selected from the group consisting of poly(dimethyldiallylammonium chloride), hexadecyltrimethylammonium bromide, and hexadecyltrimethylammonium chloride, or a mixture containing two or more kinds thereof.

7. The manufacturing method of claim 1, wherein the inorganic acid is any one selected from the group consisting of sulfuric acid ($H_2SO_4$), hydrochloric acid ($HC_1$), nitric acid ($HNO_3$), phosphoric acid ($H_3PO_4$), sulfamic acid ($SO_3HNH_2$), perchloric acid ($HC_1O_4$), chromic acid ($HC_rO_4$), sulfurous acid ($H_2SO_3$) and nitrous acid ($HNO_2$), or a mixture containing two or more kinds thereof.

8. The manufacturing method of claim 1, wherein, after step (d), re-growing the gold (Au) nanoparticles to obtain re-grown gold (Au) nanoparticles and re-etching the re-grown gold (Au) nanoparticles are performed one or more times as a unit process.

* * * * *